US009826835B1

(12) United States Patent
Carpinella

(10) Patent No.: US 9,826,835 B1
(45) Date of Patent: Nov. 28, 2017

(54) SELF-ADJUSTING FURNITURE GLIDE

(71) Applicant: Carpin Manufacturing, Inc., Waterbury, CT (US)

(72) Inventor: Ralph Carpinella, Woodbury, NJ (US)

(73) Assignee: Carpin Manufacturing, Inc., Waterbury, CT (US)

( * ) Notice: Subject to any disclaimer, the term of this patent is extended or adjusted under 35 U.S.C. 154(b) by 0 days.

(21) Appl. No.: 15/366,491

(22) Filed: Dec. 1, 2016

(51) Int. Cl.

| | |
|---|---|
| ***A47B 91/06*** | (2006.01) |
| ***A47B 91/16*** | (2006.01) |
| ***A47C 7/00*** | (2006.01) |
| ***A47B 91/02*** | (2006.01) |

(52) U.S. Cl.
CPC ..... *A47B 91/16* (2013.01); *A47B 91/02* (2013.01); *A47B 91/06* (2013.01); *A47C 7/008* (2013.01)

(58) Field of Classification Search
CPC ..... A47B 91/02; A47B 91/12; A47B 91/14; A47B 91/16; A47B 91/06; A47B 2091/063; B60B 33/00; B60B 2033/0034; B60B 2900/5112; B65G 7/02; A47C 7/008; A61H 3/0288; A61H 3/068; Y10T 16/207; Y10T 16/209; Y10T 16/211; Y10T 16/21; Y10T 16/216
See application file for complete search history.

(56) References Cited

U.S. PATENT DOCUMENTS

| | | | | | |
|---|---|---|---|---|---|
| 2,860,368 | A * | 11/1958 | Thornsbury | A47B 91/066 | 16/42 R |
| 3,646,633 | A * | 3/1972 | Meinhardt | A47B 91/06 | 16/42 R |
| 3,722,026 | A * | 3/1973 | Wilhelmi | A47B 91/06 | 16/42 R |
| 3,742,552 | A * | 7/1973 | Balchunas | A47B 91/00 | 16/42 R |
| 5,010,621 | A * | 4/1991 | Bock | A47B 91/066 | 16/39 |
| 5,042,764 | A * | 8/1991 | Carpinella | A47C 7/002 | 248/188.2 |
| 5,042,765 | A | 8/1991 | Widerstrom | | |
| 5,573,212 | A * | 11/1996 | Palazzolo | A47B 91/06 | 248/188.9 |
| 6,186,453 | B1 * | 2/2001 | Redbone | A47B 91/024 | 16/42 R |
| 7,234,199 | B2 | 6/2007 | Bushey | | |
| 7,290,741 | B1 | 11/2007 | Cox et al. | | |
| 2008/0148522 | A1 | 6/2008 | Beshore | | |

(Continued)

*Primary Examiner* — Chuck Mah
(74) *Attorney, Agent, or Firm* — Carmody Torrance Sandak & Hennessey LLP

(57) ABSTRACT

A self-adjusting furniture glide attachable to an article of furniture is described. The self-adjusting furniture glide comprises an outer shell comprising an upper portion and a lower portion, wherein the upper portion and the lower portion are joined together to form a hollow cavity and a center member disposed in the outer shell. The center member is seated in the outer shell above a cup-shaped cushion, and comprises a means capable of attaching the self-adjustable furniture guide to an article of furniture attached to a top surface of the center member. The center member is capable of vertical movement within the outer shell and the vertical movement of the center member in the outer shell compresses the cup-shaped cushion.

9 Claims, 2 Drawing Sheets

(56) References Cited

U.S. PATENT DOCUMENTS

| | | | | |
|---|---|---|---|---|
| 2009/0056071 | A1* | 3/2009 | Vorpahl | A47B 91/06 16/45 |
| 2011/0197390 | A1* | 8/2011 | Carpinella | A47B 91/066 16/30 |
| 2012/0240355 | A1 | 9/2012 | Chase | |

* cited by examiner

SELF-ADJUSTING FURNITURE GLIDE

FIELD OF THE INVENTION

The present invention relates generally to a self-adjusting furniture glide that can be secured to a free end of an article of furniture.

BACKGROUND OF THE INVENTION

It is a common occurrence to sit on a chair or at a table, desk or the like, and experience an instability due to the uneven floor surface or differential lengths of the legs, that causes tilting or wobbling. Furniture is often "leveled" with various objects, including leveling screws, folded paper, cardboard and other miscellaneous items on hand. Although such items can provide relief in the short term, they are often unsightly and undesirable or are easily dislodged.

Chairs, desks, tables and other similar furniture that are subjected to extensive use are often fabricated with glides secured to the free ends of the furniture base to help distribute the weight or load over a larger "footprint" on the floor. Often, such glides have an adjustable overall length for "leveling" the furniture, for example, by manually rotating a threaded base portion of the glide relative to a threaded socket portion. However, such manual action for adjusting glide height can involve considerable effort, especially where a multiplicity of legs require frequent adjustment.

For seated furniture items, inadequate leveling can result in discomfort or even injury to a user. Of equal concern is the need to avoid damage or abrasion to the support surfaces on which legged structures are placed. For furniture used indoors this support surface is typically carpeting, wooden floors or tiled floors. For outdoor items such as patio furniture the support surface may be concrete, brick, tile, decking and the like.

U.S. Pat. No. 7,290,742 to Cox et al., the subject matter of which is herein incorporated by reference in its entirety, describes a furniture glide that includes a cam mechanism that limits the rotatability of an upper cover with respect to a central mounting bolt to provide for hand turning of the support onto/off of a piece of furniture.

U.S. Pat. No. 7,234,199 to Bushey, the subject matter of which is herein incorporated by reference in its entirety, describes a furniture glide that may be mounted on the terminal end of a furniture leg having an outer surface and including a sleeve that extends from the base and defines a cavity for receiving the furniture leg therein. However, this device is simply mounted over the furniture leg and is not otherwise secured.

U.S. Pat. No. 5,042,765 to Widerstrom, the subject matter of which is herein incorporated by reference in its entirety, describes a self-adjusting shim device having an elastic outer bladder formed of a resilient material filled with a bouncing putty that will deform slowly under force like a highly viscous liquid but will resist rapidly applied loads as if it were a solid. The elastic outer bladder is disposed within a pair of opposed rigid cup-shaped members that are telescopically joined together. However, the rubber bladder may fail, resulting in leaking of the bouncing putty and thus failure of the shim device.

U.S. Pat. No. 5,042,764 to Carpinella et al., the subject matter of which is herein incorporated by reference in its entirety, describes a self-leveling furniture glide comprising a cup-like urethane cushion located between a rivet and a base for transferring chair load resiliently and that can be independently adjusted to level the piece of furniture.

U.S. Pat. Pub. No. 2008/0148522 to Beshon, the subject matter of which is herein incorporated by reference in its entirety, describes a glide device that includes a housing, a unitary body and a resilient member positioned between the housing and the unitary body. The glide device is adapted to stabilize a legged object on a support surface while preventing damage to either the legged object or the support surface. However, there is no suggestion that glide device is self-adjusting to allow for leveling of the legged object.

Thus, it can be seen that while various self-leveling furniture glides have been developed, there remains a mains a need in the art for an improved self-adjusting furniture glide that overcomes the deficiencies of the prior art. In addition, there remains a need in the art for a self-adjusting furniture glide that is simple in construction, economical to manufacture and that is rugged and reliable in use.

SUMMARY OF THE INVENTION

It is an object of the present invention to provide an improved self-adjusting furniture glide.

It is another object of the present invention to provide a self-adjusting furniture glide that can be easily and quickly installed to prevent tilting or wobbling of a supported article of furniture due to uneven floors or legs or bases of unequal length.

It is still another object of the present invention to provide a self-adjusting furniture glide that is simple in construction, economical to manufacture and that is rugged and reliable in use.

To that end, the present invention relates generally to a self-adjusting furniture glide attachable to an article of furniture, the self-adjusting furniture glide comprising:

an outer shell comprising an upper portion and a lower portion, wherein the upper portion and the lower portion are joined together to form a hollow cavity, a center member disposed in the outer shell, wherein the center member is seated in the outer shell above a cup-shaped cushion, and wherein the center member comprises a means capable of attaching the self-adjustable furniture guide to a leg of an article of furniture attached to a top surface of the center member; and wherein the center member is capable of vertical movement within the outer shell and wherein vertical movement of the center member in the outer shell compresses the cup-shaped cushion.

BRIEF DESCRIPTION OF THE FIGURES

For a fuller understanding of the invention, reference is made to the following description taken in connection with the accompanying figures, in which.

Also, while not all elements may be labeled in each figure, all elements with the same reference number indicate similar or identical parts.

DETAILED DESCRIPTION OF THE PREFERRED EMBODIMENTS

The present invention relates generally to a self-adjusting furniture glide attachable to an article of furniture. Thus, as described herein, in one embodiment the present invention relates generally to a self-adjusting furniture glide comprising:

an outer shell comprising an upper portion and a lower portion, wherein the upper portion and the lower portion are joined together to form a hollow cavity, a center member disposed in the outer shell, wherein the center member is seated in the outer shell above a cup-shaped cushion, and wherein the center member comprises a means capable of attaching the self-adjustable furniture guide to an article of furniture attached to a top surface of the center member; and wherein the center member is capable of vertical movement within the outer shell and wherein vertical movement of the center member in the outer shell compresses the resilient cushion.

By "self-adjusting" or "self-adjustable" what is meant is that the furniture glide adjusts or levels the leg(s) of the article of furniture without any manual action involving a leveling screw or similar device.

Figure 1:
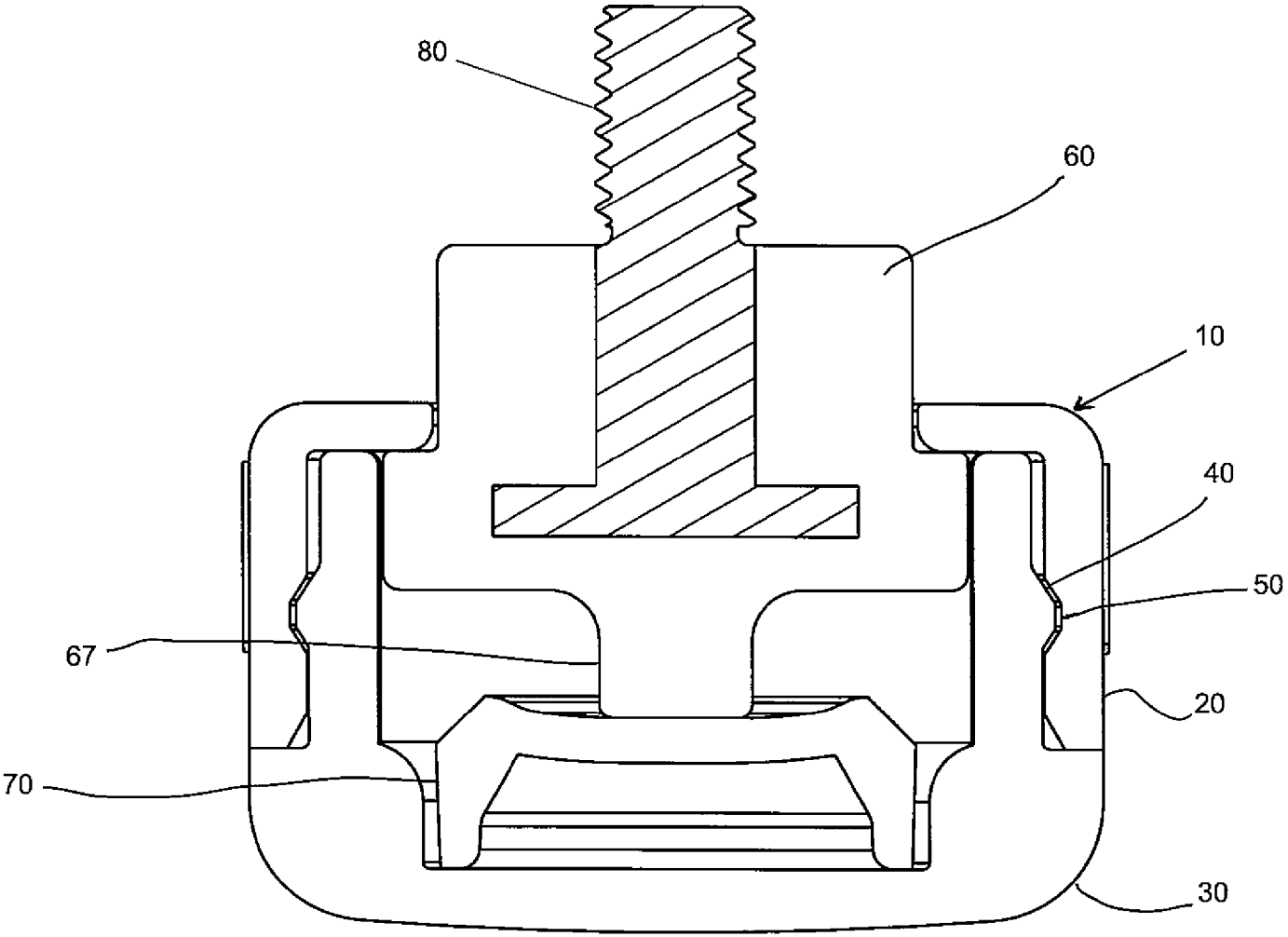
FIG. 1 depicts a cross-sectional view of a self-adjusting furniture glide in accordance with one aspect of the present invention.

In one embodiment and as shown in FIG. 1, the self-adjusting furniture glide of the invention comprises an outer shell 10 comprising an upper portion 20 and a lower portion 30 that are joined together. The upper portion 20 and the lower portion 30 have substantially the same outer diameter and can be joined together to provide a unitary construction that forms a hollow cavity in which the center member 60 and cup-shaped cushion 70 are disposed. In one embodiment, the upper portion 20 and the lower portion 30 are snap-fit together. In other embodiments, the upper portion 20 and lower portion may be joined together by glues and other adhesives, press-fitting, and screwing the upper portion 20 and lower portion 30 together. Other similar means of joining the upper portion 20 and lower portion 30 together would also be known to those skilled in the art.

One such means for joining the upper portion 20 and lower portion 30 together comprises a raised annular ridge 40 on an outer surface of the lower portion 30 that engages a corresponding annular indent 50 on the inner surface of the upper portion 20. In the alternative the raised annular ridge 40 and corresponding annular indent 50 may be reversed on the upper portion 20 and the lower portion 30. In other embodiments, a series of raised ridges and corresponding notches or other similar connection means may be disposed around the circumference of the inner surface of the upper portion 20 and the outer surface of the lower portion 30 to join the two portions together and form the outer shell 10. Therefore, what is necessary is that the upper portion 20 and lower portion 30 are joined to provide a unitary construction.

The lower portion 30 of the outer shell 10 includes a flat annular base that is dimensioned to retain the cup-shaped cushion 70. The lower portion 30 also preferably comprises an inner wall 35 that is capable of preventing rotation of the center member 60 relative to the lower portion 30 of the outer shell 10. In one embodiment, the inner wall 35 of the lower portion 30 of the outer shell 10 comprises one or more flat sections 36 that match up with one or more corresponding flat sections 66 in a lower section of the center member 60. The flat sections 36 and 66 match up to prevent rotation of the center member 60 relative to the outer shell 10. In addition, the flat sections 36 and 66 preferably comprise at least one set of flat sections, more preferably two sets of flat sections and may comprise multiple sets of flat sections that match up to prevent rotation.

Figure 2:
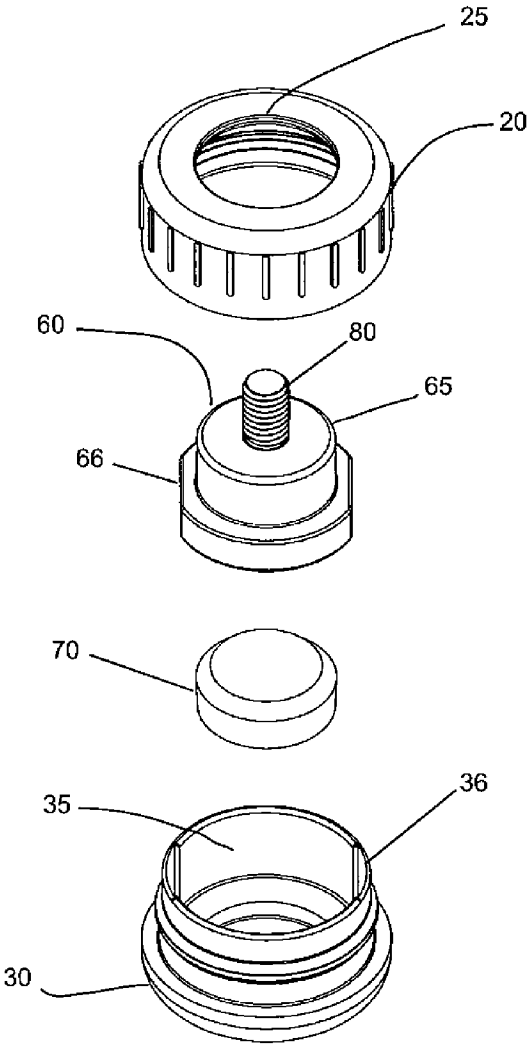
FIG. 2 depicts an exploded view of a self-adjusting furniture glide in accordance with one aspect of the present invention.

Optionally, but preferably, both the outer shell 10 and the center member 60 are constructed of a hard plastic. As seen in FIGS. 1 and 2, the center member 60 is disposed in the outer shell 10 and is seated in the outer shell 10 above a cup-shaped cushion 70. The upper portion 20 of the outer shell 10 comprises a substantially spherical opening 25 (shown best in FIG. 2) that is dimensioned to receive an upper portion of the center member 60. The upper portion of center member 60 also comprises a means 80 capable of attaching the self-adjustable furniture guide 10 to an article of furniture attached to a top surface of the center member. The center member 60 is capable of vertical movement within the outer shell 10, and the vertical movement of the center member 60 in the outer shell compresses the cup-shaped cushion 70 to provide leveling of the article of furniture. In addition, and as seen in the exploded view of the furniture glide depicted in FIG. 2, the center member 60 is not attached to the outer shell 10 but is free to move vertically within the confines of the outer shell 10.

The center member 60 also optionally, but preferably, also comprises a protrusion 67 on a bottom of the center member 60. Thus, as the center member 60 is compressed, the protrusion 67 contacts and depresses the cup-shaped cushion, causing the article of furniture to level.

The cup-shaped cushion 70 is most preferably in an inverted position in the lower portion 30 of the outer shell 10 such that the open, rim portion rests on the interior of the lower portion 30 of the outer shell 10. Preferably, the upper surface of the cup-shaped cushion 70 is curved in its relaxed state prior to any downward pressure being exerted on the cup-shaped cushion by the center member 60. The cup-shaped cushion 70 is rigidly supported by the lower portion 30 of the outer shell enough to avoid collapsing under the distributed neutral weight of a piece of furniture yet resilient enough to deflect the necessary amount (i.e., fraction(s) of an inch) to achieve the leveling effect required under neutral weight. The cup-shaped cushion 70 is preferably constructed of a resilient plastic material such as a solid elastomeric polyurethane. Other materials that are capable of deflecting the necessary amount to achieve the required leveling effect while avoiding collapsing would also be usable in the practice of the invention.

Although the self-adjusting furniture glide 10 may be installed on the bottom of an article of furniture by means of a threaded rod 80, it should be understood that other suitable fastening means may also be used including, for example, nails, glues and other suitable fasteners. The threaded rod 80 is capable of mating/connecting with matching threads (not shown) in the article of furniture.

In one preferred embodiment, the center member 60 is molded over the threaded rod 80 as shown in FIG. 1 such that the threaded rod is secured in the center member.

The self-adjusting furniture glide described herein is couplable with the bottom or base of the article of furniture and the weight of the article is supported on the self-adjusting furniture glide(s). Pressure can be applied to the article of furniture, causing the center member 60 to compress and depress the C-shaped cushion 70 and cause the piece of furniture to level. The self-adjusting furniture glide 10 described herein substantially reduces or eliminates any tilting or wobbling action of the articles under which it is placed and compensates for an unevenness in the floor or legs of unequal length.

The self-adjusting furniture glide described herein may be attached or adhered, for example, to one or more legs of an article of furniture or may be attached to a table base or pedestal. When the furniture glide(s) are attached to a table base or pedestal, multiple furniture glides may be used. In addition, as known to those skilled in the art, the table base or pedestal may comprise multiple legs or prongs that each may have one or more self-adjusting furniture glides attached thereto.

Thus, it can be seen that the self-adjusting furniture glide described herein can compensate for the unevenness of floors and other surfaces and allow articles of furniture to be moved and self-leveled.

In addition, it is also contemplated that the self-adjusting glide described herein can be applied to other legged objects, including appliances (washers, dryers, etc.) that also require leveling.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

Finally, it should also be understood that the following claims are intended to cover all of the generic and specific features of the invention described herein and all statements of the scope of the invention that as a matter of language might fall there between.

What is claimed is:

1. A self-adjusting furniture glide attachable to an article of furniture, the self-adjusting furniture glide comprising:

an outer shell comprising an upper portion and a lower portion, wherein the upper portion and the lower portion are joined together to form a hollow cavity, a center member disposed in the outer shell, wherein the center member is seated in the lower portion of the outer shell above a cup-shaped cushion, and wherein the center member comprises a means capable of attaching the self-adjustable furniture guide to an article of furniture attached to a top surface of the center member;

wherein the lower portion of the outer shell comprises substantially vertical side walls and a flat annular base, wherein the flat annular base is dimensioned to retain the cup-shaped cushion; and wherein the center member is capable of vertical movement within the outer shell and wherein vertical movement of the center member in the outer shell compresses the cup-shaped cushion.

2. The self-adjusting furniture glide according to claim 1, wherein the cup-shaped cushion comprises a resilient plastic.

3. The self-adjusting furniture glide according to claim 1, wherein the means capable of attaching the self-adjusting furniture glide to the article of furniture is a threaded rod.

4. The self-adjusting furniture glide according to claim 3, wherein the center member is molded over the threaded rod, wherein the threaded rod is secured in the center member.

5. The self-adjusting furniture glide according to claim 1, wherein the center member further comprises a protrusion on a bottom of the center member, wherein as the center member is compressed, the protrusion depresses the cup-shaped cushion.

6. The self-adjusting furniture glide according to claim 1, wherein the upper portion and the lower portion of the outer shell are joined together by snapfitting, gluing, press-fitting or screwing the upper portion and the lower portion together.

7. The self-adjusting furniture glide according to claim 1, wherein the upper portion of the outer shell comprises a substantially spherical opening dimensioned to receive a shoulder of the center member.

8. The self-adjusting furniture glide according to claim 1, wherein the outer shell and the center member are constructed of a hard plastic.

9. The self-adjusting furniture glide according to claim 1, wherein at least a portion of an outer wall of the center member and at least a portion of a corresponding inner wall of the lower portion of the outer shell each comprise at least one flat section, wherein the at least one flat section of the outer wall of the center member and the at least one flat section of the inner wall of the lower portion of the outer shell match up with each other to prevent rotation.

* * * * *